United States Patent [19]

Ellis

[11] Patent Number: 4,720,450

[45] Date of Patent: Jan. 19, 1988

[54] THERMAL IMAGING METHOD

[75] Inventor: Ernest W. Ellis, Carlisle, Mass.

[73] Assignee: Polaroid Corporation, Cambridge, Mass.

[21] Appl. No.: 863,454

[22] Filed: May 15, 1986

Related U.S. Application Data

[63] Continuation-in-part of Ser. No. 740,885, Jun. 3, 1985, abandoned.

[51] Int. Cl.[4] ..... G03C 1/72

[52] U.S. Cl. ..... 430/339; 430/343; 430/945; 430/955; 430/964; 503/218; 503/221; 503/222; 548/455; 548/467; 564/42; 564/44; 564/51; 564/56

[58] Field of Search ..... 430/964, 338, 332, 343, 430/955, 945, 339; 503/221, 222, 218; 548/207, 467, 455; 564/42, 44, 51, 56

[56] References Cited

U.S. PATENT DOCUMENTS

| | | | |
|---|---|---|---|
| Re. 29,168 | 4/1977 | Haseltine et al. | 430/522 |
| 3,488,705 | 1/1970 | Fox et al. | 430/83 |
| 3,745,009 | 7/1973 | Jenkins et al. | 430/522 |
| 3,832,212 | 8/1974 | Jenkins et al. | 430/495 |
| 4,380,629 | 4/1983 | Yamashita et al. | 542/455 |
| 4,416,971 | 11/1983 | Borror et al. | 430/383 |
| 4,602,263 | 7/1986 | Borror et al. | 346/201 |

*Primary Examiner*—Won H. Louie
*Assistant Examiner*—Mark R. Buscher

[57] ABSTRACT

A method of thermal imaging is provided which comprises heating imagewise a layer of a colored di- or triarylmethane compound possessing within its di- or triarylmethane structure an aryl group substituted in the ortho-position to the meso carbon atom with a group comprising a thermally unstable urea moiety which fragments upon heating to provide a new group that bonds to the meso carbon atom whereby the di- or triarylmethane compound is rendered ring-closed and colorless in an imagewise pattern corresponding to said imagewise heating.

16 Claims, No Drawings

THERMAL IMAGING METHOD

CROSS-REFERENCE TO RELATED APPLICATION

This application is a continuation-in-part of copending application Ser. No. 740,885 filed June 3, 1985, now abandoned.

BACKGROUND OF THE INVENTION

1. Field of the Invention

This invention relates to heat-sensitive recording elements useful for making color images, to a method of imaging using said elements and to novel organic compounds useful as the image-forming materials in said heat-sensitive recording elements.

2. Description of the Prior Art

A variety of thermal imaging systems for producing color images have been proposed. In one type of heat-sensitive recording system, a first sheet containing a first reagent is superposed with a second sheet containing a second reagent and one of the reagents is melted or vaporized by the imagewise application of heat and transferred for reaction with the other reagent to form a color image. In another type of "transferring system", images are formed by sequentially transferring two or more dyes carried on separate donor sheets to a common receptor sheet by melting or volatilization. In thermal imaging systems of the "self-containing" type, a single sheet is used and the imagewise heating of the heat-sensitive sheet produces a color image, for example, by rendering a coating layer transparent to reveal the color of a background layer, by initiating the chemical reaction of two or more reagents to form a colored product or by bleaching, coloring or changing the color of a single reagent.

A number of compounds of the latter type, that is, single compounds which undergo a color change upon application of heat have been disclosed. U.S. Pat. No. 3,488,705 discloses thermally unstable organic acid salts of triarylmethane dyes useful in electrophotographic elements as sensitizing dyes that are decomposed and bleached upon heating. U.S. Pat. No. 3,745,009 reissued as U.S. Pat. No. 29,168 and U.S. Pat. No. 3,832,212 disclose heat-sensitive compounds for thermography containing a heterocyclic nitrogen atom substituted with an —OR group, for example, a carbonate group that decolorize by undergoing homolytic or heterolytic cleavage of the nitrogen-oxygen bond upon heating to produce an RO+ ion or RO' radical and a dye base or dye radical which may in part fragment further. U.S. Pat. No. 4,380,629 discloses styryl-like compounds which undergo coloration or bleaching, reversibly or irreversibly via ring-opening and ring-closing in response to activating energies such as light, heat or electric potential, and copending U.S. patent application Ser. No. 646,771 of Alan L. Borror, Ernest W. Ellis and Donald A. McGowan filed Sept. 9, 1984, now U.S. Pat. No. 4,602,263, discloses organic compounds that undergo color formation or color bleaching by an irreversible unimolecular fragmentation of at least one thermally unstable carbamate moiety, for example, triarylmethane compounds including bridged triarylmethane compounds comprising a carbamate moiety, such as,

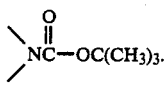

SUMMARY OF THE INVENTION

The present invention is concerned with thermal imaging systems employing compounds that undergo a color change due to a unimolecular fragmentation reaction of a different type. In particular, the formation of color images in accordance with the present invention relies upon the unimolecular fragmentation of one or more urea moieties to effect a visually discernible color shift from colorless to colored, from colored to colorless or from one color to another. In a preferred embodiment, the present invention is concerned with thermal imaging systems employing certain di- and triarylmethane compounds possessing a thermally unstable urea group. Because the subject compounds undergo a unimolecular reaction, the color change can be achieved without the need for transferring a reagent or for contacting two reagents, and because the reaction may be carried out at moderately elevated temperatures, any conventional heating means for effecting imagewise heating may be employed. Also, di- and triarylmethane compounds useful in the subject thermal imaging systems may be selected to provide a wide range of colors including black as may be desired not only in the production of monochromes and bichromes but in the production of full color images as well.

It is, therefore, the primary object of the present invention to provide a method of thermal imaging for producing color images.

It is another object of the present invention to provide heat-sensitive recording elements useful in said method.

It is yet another object of the present invention to provide a new class of heat-sensitive compounds useful in the subject thermal imaging systems.

Other objects of the invention will in part be obvious and will in part appear hereinafter.

The invention accordingly comprises the methods involving the several steps and the relation and order of one or more of such steps with respect to each of the others, and the products and compositions possessing the features, properties and the relation of elements which are exemplified in the following detailed disclosure, and the scope of the application of which will be indicated in the claims.

For a fuller understanding of the nature and objects of the invention, reference should be had to the following detailed description.

DESCRIPTION OF THE PREFERRED EMBODIMENTS

In accordance with the present invention, a method of thermal imaging is provided which comprises heating imagewise a heat-sensitive element comprising a support carrying at least one imaging layer of a compound possessing a thermally unstable urea moiety capable of undergoing a unimolecular fragmentation reaction, said compound initially absorbing in the visible or non-visible region of the electromagnetic spectrum and said imagewise heating effecting said fragmentation of said urea moiety whereby the absorption of said compound is visibly changed in said layer in an imagewise pattern corresponding to said imagewise heating.

In a preferred embodiment, the compound is a colored di- or triarylmethane compound possessing in its di- or triarylmethane structure an aryl group substituted on the carbon atom in the ortho-position to the meso carbon atom, i.e., the methane carbon atom, with a group comprising a thermally unstable urea moiety, which urea moiety is capable of undergoing a unimolecular fragmentation reaction upon heating to provide a new group in said ortho position that bonds to the meso carbon atom to form a ring having 5 or 6 members whereby said di- or triarylmethane compound becomes ring-closed and is rendered colorless.

Preferably, the group comprising the urea moiety is a carbonylurea, a methyleneurea and particularly a sulfonylurea group. For producing multicolor images, at least two imaging layers of di- or triarylmethane compound are employed and the respective imaging compounds absorb radiation at different predetermined wavelengths in the visible region of the electromagnetic spectrum.

Typical of the colored di- or triarylmethane compounds that may be used in the present invention are the novel compounds represented by the formula

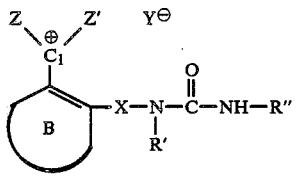

(I)

wherein the ring B represents a carbocyclic aryl ring, e.g., of the benzene or naphthalene series or a heterocyclic aryl ring, e.g., pyridine or pyrimidine; $C_1$ represents the meso carbon atom; X represents

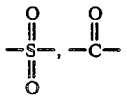

or $—CH_2—$; R′ represents a negative charge, an alkyl group usually containing 1 to 6 carbon atoms or an acyl group usually —COR‴ wherein R‴ is alkyl usually containing 1 to 6 carbon atoms, benzyl or phenyl, provided R′ is said alkyl group or acyl group when X represents $—CH_2—$; R″ represents phenyl or naphthyl; and Z and Z′ taken individually represent the moieties to complete the auxochormophoric system of a diarylmethane or a triarylmethane dye and Z and Z′ taken together represent the bridged moieties to complete the auxochromophoric system of a bridged triarylmethane dye; and Y⊖ is an anion when R′ is said alkyl group or acyl group.

In a preferred embodiment, B represents a benzene ring and Z and Z′ taken individually represent the aryl moieties, the same or different, to complete the auxochromophoric system of a triarylmethane dye and Z and Z′ when taken together represent the bridge aryl moieties to complete the auxochromophoric system of a bridged triarylmethane dye. Usually, at least one of Z and Z′ whether taken individually or together possesses as an auxochromic substituent, a nitrogen, oxygen or sulfur atom or a group of atoms containing nitrogen, oxygen or sulfur.

In the triarylmethane compounds represented in formula I above, the aryl moieties Z and Z′, when taken individually, may be the same or different and typically represent heterocyclic aryl groups containing nitrogen, oxygen or sulfur as the heterocyclic atom, particularly N-heterocyclic aryl groups such as julolidin-3-yl, indol-3-yl, pyrr-2-yl, carbazol-3-yl, and indolin-5-yl wherein the N atom of the indolyl, pyrryl, carbazolyl and indolinyl groups may be substituted with hydrogen or alkyl having 1 to 6 carbon atoms, or the aryl moieties Z and Z′ typically may be carbocyclic aryl, particularly phenyl or naphthyl groups which include an appropriately positioned auxochromic substituent, i.e., an atom or group that produces an auxochromic effect, which substituent is usually positioned para to the meso carbon atom. Typically, Z and Z′ when taken together represent aryl groups bridged by a heteroatom, such as, oxygen, sulfur or nitrogen to form, for example, 4H-chromeno[2,3-C]pyrazole and particularly represent carbocyclic aryl groups, such as, phenyl groups bridged with a heteroatom, preferably oxygen, sulfur or nitrogen substituted with hydrogen or an alkyl group having 1 to 6 carbon atoms to provide a xanthene, thioxanthene or an acridine dye, which dyes possess an auxochromic substituent(s) para to the meso carbon atom, i.e., in the 3-position or in the 3,6-positions or meta and para to the meso carbon atom, i.e., in the 3,7-positions.

In the diarylmethane compounds, one of Z and Z′ may be heterocyclic aryl or carbocyclic aryl as discussed above and the other of Z and Z′ may be, for example, phenoxy, thiophenoxy, alkoxy containing 1 to 20 carbon atoms, alkylthio containing 1 to 20 carbon atoms, —N,N-(disubstituted)amino wherein each said substituent may be alkyl containing 1 to 20 carbon atoms, carbocyclic aryl containing 6 to 12 carbon atoms, aralkyl containing 7 to 15 carbon atoms particularly phenyl- and naphthyl-substituted alkyl or alkaryl containing 7 to 15 carbon atoms particularly alkyl-substituted phenyl and naphthyl. Representative alkyl groups include methyl, butyl, hexyl and octadecyl and representative aryl groups include phenyl and naphthyl. Representative alkaryl groups include p-octylphenyl, o-methylnaphthyl and p-hexylphenyl, and representative aralkyl groups include phenethyl, benzyl and naphthylmethyl.

Examples of useful auxochromic substituents include $—OR_1$ wherein $R_1$ is hydrogen, alkyl usually having 1 to 6 carbon atoms, aralkyl usually having 7 to 15 carbon atoms, alkaryl usually having 7 to 15 carbon atoms or carbocyclic aryl usually having 6 to 12 carbon atoms; $—SR_2$ wherein $R_2$ has the same meaning given for $R_1$; $—NR_3R_4$ wherein $R_3$ and $R_4$ each represent hydrogen, alkyl usually having 1 to 6 carbon atoms, β-substituted ethyl, cycloalkyl usually having 5 to 7 carbon atoms, aralkyl usually having 7 to 15 carbon atoms, alkaryl usually having 7 to 15 carbon atoms or

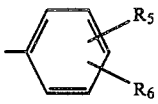

wherein $R_5$ and $R_6$ each are hydrogen, alkyl usually having 1 to 6 carbon atoms, halo such as chloro, bromo, fluoro and iodo, nitro, cyano, alkoxycarbonyl wherein said alkoxy has 1 to 6 carbon atoms, sulfonamide ($-NHSO_2R_0$), sulfamoyl ($-SO_2NHR_0$), sulfonyl ($-SO_2R_0$), acyl ($-COR_0$) or carbamyl ($-CONR_0$) wherein $R_0$ usually is alkyl having 1 to 6 carbon atoms, benzyl or phenyl and $R_3$ and $R_4$ taken together represent the atoms necessary to complete a heterocyclic ring usually piperidino, pyrrolidino, N-methylpiperidino, morpholino or

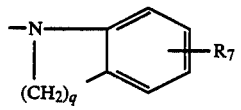

wherein q is an integer 2 to 5 and $R_7$ has the same meaning as $R_5$; and

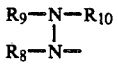

wherein $R_8$ and $R_9$ each are hydrogen, alkyl usually having 1 to 6 carbon atoms or

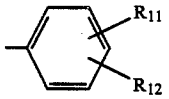

wherein $R_{11}$ and $R_{12}$ have the same meaning as $R_5$ and $R_6$ and $R_{10}$ is $-COR_{13}$, $-CSR_{13}$ or $-SO_2R_{13}$ wherein $R_{13}$ is hydrogen, alkyl usually having 1 to 6 carbon toms, phenyl, $-NH_2$, $-NHR_{14}$, $-N(R_{14})_2$ or $-OR_{14}$ wherein $R_{14}$ is hydrogen, alkyl usually containing 1 to 6 carbon atoms or phenyl. Representative alkyl groups include methyl, ethyl, propyl, butyl and hexyl. Representative β-substituted ethyl groups include β-methoxymethoxyethyl and β-2'-tetrahydropyranyloxyethyl. Representative aralkyl groups include phenyl and naphthyl-substituted alkyl such as, benzyl, phenethyl and naphthylmethyl and representative alkaryl groups include alkyl-substituted phenyl and naphthyl, such as, o-methylphenyl, o-methylnaphthyl and p-hexylphenyl. Representative carbocyclic aryl groups include phenyl and naphthyl and representative cycloalkyl groups include cyclopentyl, cyclohexyl and cycloheptyl. It will be appreciated that the auxochromic substituent(s) will be selected for a given diarylmethane, triarylmethane or bridged triarylmethane compound to provide the desired chromophore color and to achieve facile color formation.

The phenyl or naphthyl groups comprising R'' in the above compounds may be unsubstituted or substituted with one or more monovalent organic groups, that do not adversely affect the thermally initiated fragmentation reaction. Preferably, R'' is phenyl or substituted phenyl, particularly phenyl substituted with one or more electron-withdrawing groups, i.e., a group(s) having a positive sigma value as defined by Hammett's Equation. Representative electron-withdrawing groups include cyano, dibenzylsulfonamido, dimethylsulfonamido, methylsulfonyl, phenylsulfonyl, p-tolylsulfonyl, carboxy, acetyl, carboethoxy, carbamyl, isothiocyano, benzoyl, trifluoromethyl and halo, e.g., chloro, fluoro, bromo and iodo. In addition to the groups specified above, a number of other groups together with their sigma values are listed in Lang's Handbook of Chemistry and in H. H. Jaffe, A Reexamination of the Hammett Equation, Chem. Reviews, 1953, pp. 222–23.

In addition to the auxochromic substituents, Z and/or Z' and/or the ring B of the ring-closing moiety may possess one or more additional substituents as may be desired that do not interfere with the intended utility for the dye. Typical substituents include carboxy; hydroxy; cyano; thiocyano; mercapto; sulfo; nitro; sulfonamido ($-NHSO_2R_0$); sulfamoyl ($-SO_2NHR_0$); sulfonyl ($-SO_2R_0$); acyl ($-COR_0$); carbamyl ($-CONR_0$); halomethyl such as trifluoromethyl; alkyl usually having 1 to 20 carbon atoms such as methyl, octyl, hexadecyl; alkoxy usually having 1 to 20 carbon atoms such as methoxy, ethoxy, propoxy and butoxy; alkoxycarbonyl having 1 to 6 carbon atoms such as methoxy- and ethoxycarbonyl; aralkyl usually having 7 to 15 carbon atoms, for example, phenyl or naphthyl-substituted alkyl such as benzyl, phenethyl and naphthylmethyl; alkaryl usually having 7 to 15 carbon atoms, for example, alkyl-substituted phenyl or naphthyl such as o-methylphenyl, o-methylnaphthyl and p-hexylphenyl; aralkyloxy usually having 7 to 15 carbon atoms, for example, phenyl or naphthyl-substituted alkoxy, such as benzyloxy, phenethyloxy and naphthylmethyloxy; aryloxy usually containing 6 to 12 carbon atoms such as phenoxy and naphthoxy; thioalkyl groups usually having 1 to 20 carbon atoms such as methylthio, ethylthio and hexylthio; thioaryl and thioaralkyl groups containing up to 15 carbon atoms such as phenylthio, naphthylthio, benzylthio and phenethylthio; halo such as chloro, bromo, fluoro and iodo; amino including mono- and disubstituted amino such as $-NR_8R_9$ wherein $R_8$ and $R_9$ each are hydrogen, alkyl usually having 1 to 20 carbon atoms, aralkyl usually having 7 to 15 carbon atoms, alkaryl usually having 7 to 15 carbon atoms, and carbocyclic aryl usually having 6 to 12 carbon atoms; and a fused substituent such as a fused benzene ring.

Preferred compounds for use in the present invention are those represented by the formula

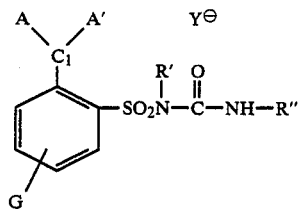

(II)

wherein $C_1$ represents the meso carbon atom; R' represents a negative charge, alkyl usually containing 1 to 6 carbon atoms or —COR''' wherein R''' is alkyl usually containing 1 to 6 carbon atoms, benzyl or phenyl; R'' is phenyl, unsubstituted or substituted with an electron-withdrawing group; G is hydrogen, alkyl having 1 to 6 carbon atoms, alkoxy having 1 to carbon atoms, alkoxycarbonyl having 1 to 6 carbon atoms, carboxy, cyano, thiocyano, nitro, sulfo, sulfonamido, sulfamoyl, sulfonyl, acyl, carbamyl, halo, —OR wherein R is hydrogen, alkyl having 1 to 6 carbon atoms, benzyl or phenyl, $-SR^0$ wherein $R^0$ has the same meaning as R or $-NR^5R^6$ wherein $R^5$ and $R^6$ each are hydrogen, alkyl having 1 to 6 carbon atoms, β-substituted ethyl, benzyl or phenyl; A and A', the same or different, are selected from phenyl substituted in the 4-position with $-OR^1$ wherein $R^1$ has the same meaning as R, $-SR^2$ wherein $R^2$ has the same meaning as R or $-NR^5R^6$ wherein $R^5$ and $R^6$ have the same meaning given above and substituted in the 2-, 3-, 5- and 6-positions with hydrogen, alkyl having 1 to 6 carbon atoms, alkoxy having 1 to 6 carbon atoms or chloro or substituted in the 5- and 6-positions with a fused benzene ring; indol-3-yl substituted in the 1 and 2 positions with hydrogen, alkyl having 1 to 6 carbon atoms, benzyl or phenyl; pyrr-2-yl substituted in the 1-position with hydrogen, alkyl having 1 to 6 carbon atoms, benzyl or phenyl; and carbazol-3-yl substituted in the 9-position with hydrogen, alkyl having 1 to 6 carbon atoms, benzyl or phenyl; and A and A' taken together represent phenyl groups bridged by a heteroatom selected from oxygen, sulfur and nitrogen substituted with hydrogen or alkyl having 1 to 6 carbon atoms to form xanthene, thioxanthene or acridine (a) substituted in the 3- and 6-positions with a group, the same or different, selected from —$OR^3$ wherein $R^3$ has the same meaning as R, —$SR^4$ wherein $R^4$ has the same meaning as R; —$NR^7R^8$ wherein $R^7$ is hydrogen or alkyl having 1 to 6 carbon atoms and $R^8$ is alkyl having 1 to 6 carbon atoms, benzyl or

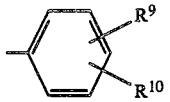

wherein $R^9$ and $R^{10}$ each are hydrogen, alkyl usually having 1 to 6 carbon atoms, alkoxy having 1 to 6 carbon atoms, chloro, nitro, cyano, alkoxycarbonyl wherein said alkoxy has 1 to 6 carbon atoms, sulfonamido, sulfamoyl, sulfonyl, acyl, or carbamyl and $R^9$ and $R^{10}$ taken together represent indolino and

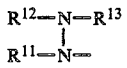

wherein $R^{11}$ and $R^{12}$ each are hydrogen, alkyl having 1 to 6 carbon atoms or

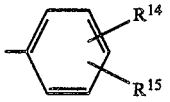

wherein $R^{14}$ and $R^{15}$ have the same meaning as $R^9$ and $R^{10}$ and $R^{13}$ is —$COR^{16}$ wherein $R^{16}$ is hydrogen, alkyl having 1 to 6 carbon atoms or phenyl and substituted in the 1-, 2-, 4-, 5-, 7- and 8-positions with hydrogen, alkyl having 1 to 6 carbon atoms, alkoxy having 1 to 6 carbon atoms or chloro or (b) substituted in the 3-position with —$NR^{17}R^{18}$ wherein $R^{17}$ is hydrogen, alkyl having 1 to 6 carbon atoms, cycloalkyl having 5 to 7 carbon atoms, benzyl or phenyl and $R^{18}$ is alkyl having 1 to 6 carbon atoms, cycloalkyl having 5 to 7 carbon atoms, benzyl or phenyl and $R^{17}$ and $R^{18}$ taken together represent piperidino, pyrrolidino, N-methylpiperidino or indolino and (1) substituted in the 7- and 8-positions with a fused benzene ring or (2) substituted in the 7-position with hydrogen, —$NR^{17}R^{18}$ wherein $R^{17}$ and $R^{18}$ have the same meaning given above, alkyl having 1 to 6 carbon atoms, alkoxy having 1 to 6 carbon atoms or chloro and substituted in the 1-, 2-, 4-, 5-, 6- and 8-positions with hydrogen, alkyl having 1 to 6 carbon atoms, alkoxy having 1 to 6 carbon atoms or chloro; and $Y^{\ominus}$ is an anion when said R' is said alkyl or acyl.

The anion $Y^{\ominus}$ associated with the compounds of the foregoing formulae when the nitrogen atom does not possess a negative charge may be any single atomic ion or ionic group composed of a plurality of atoms having a negative charge, for example, halide, such as chloride, bromide or iodide, nitrate, tetrafluoroborate, perchlorate, periodate, acetate, oxalate, tosylate, sulfate, methane sulfonate, methane hydrogen disulfonate, m-benzene hydrogen disulfonate, trifluoroacetate, hexafluoroacetate, hexafluorophosphate, azide or trifluoromethane sulfonate.

The compounds of the foregoing formulae may be synthesized in a conventional manner by heating an isocyanate with a di- or triarylmethane compound possessing, for example, a sultam or other appropriate moiety to give the desired product. Various diarylmethane and triarylmethane dyes including bridged triarylmethanes possessing these ring-closed moieties or capable of being derivatized with these moieties have been disclosed in the art. For example, various lactones and lactams have been described in Venkataraman, K., The Chemistry of Synthetic Dyes, Academic Press, Inc., New York, 1952 pp. 705–760 and 1111, in Beilstein's Handbuch der Organischem Chemie, vol. 27, p. 431 and p. 534, in Dutt, J. Chem. Soc. 121, p. 2389 (1922), in French Pat. No. 1,519,027, in German Pat. Nos. 100,779 and 100,780 and in U.S. Pat. Nos. 3,491,111, 3,491,112, 3,491,116, 3,509,173, 3,509,174, 3,514,310, 3,514,311, 3,775,424, 3,853,869, 3,872,046, 3,931,227, 3,959,571, 4,341,403, 4,535,172 and 4,535,348. The preparation of lactams by reacting the ethylester of a lactone with an amine in a conventional manner also is described in U.S. Pat. No., 4,316,950. Also, certain N-acylated lactams, sultams, and benzylamines that undergo cleavage to the corresponding —HN or —Nalkyl ring-closed triarylmethane compound by treatment with alkali are disclosed in U.S. Pat. Nos. 4,139,381, 4,178,446, 4,195,180, 4,259,493, 4,304,833, 4,316,950 and 4,345,017. The syntheses described in these patents also may be employed to prepare the lactam, sultam and benzylamine compounds directly by omitting or removing the hydroxyl protecting groups from the intermediates.

As an example of preparing compounds useful in the subject thermal imaging systems, the magenta compound having the formula set out below was prepared as follows:

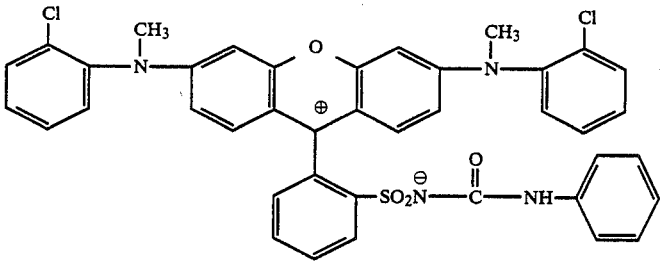

Compound 1

A flask was charged with 0.58 g of Compound A having the formula

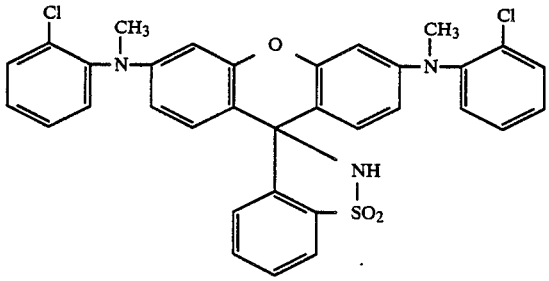

and one equivalent of phenylisocyanate. The flask was heated in an oil bath for about 45 minutes, then a second equivalent of phenylisocyanate was added and heating continued for about 30 minutes. The desired product (Compound 1) was isolated from the reaction mixture via column chromatography on silica gel using ethylacetate as eluant. M/e+ 733–734.

The magenta compound prepared above was dissolved in tetrahydrofuran and coated on gelatin subcoated polyethylene terephthalate on the gelatin layer, coated on the opposite side, coated on a glass slide and absorbed on filter paper. All four coatings gave equivalent magenta density after drying.

A second coating on a glass slide prepared as above was heated above 200° C. The coating upon heating was completely decolorized by cleavage of the sulfonyl urea moiety to eliminate the isocyanate

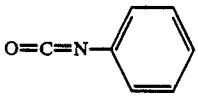

followed by ring closure of the triarylmethane to give colorless Compound A as determined by thin layer chromotography in comparison with an authentic sample.

As a further illustration of the present invention, Compound A was heated with the isocyanate of the formula

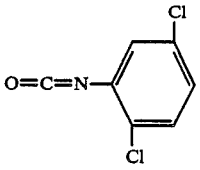

to give the following magenta product

Compound 2

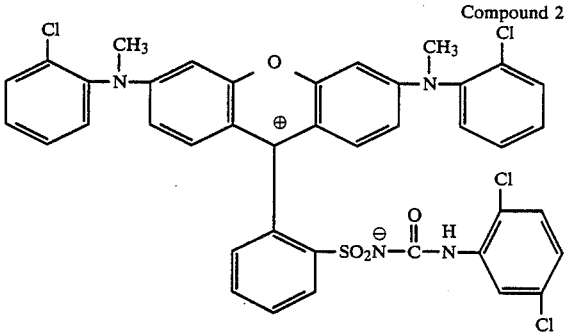

This magenta compound when heated to 150°–250° C. was rendered colorless.

In addition to the above, Compound B having the formula

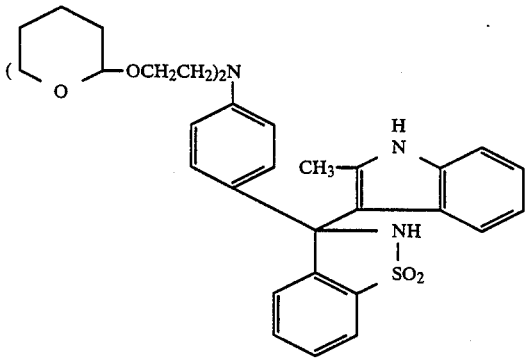

was heated with an equivalent of phenylisocyanate to give the following yellow product Compound 3
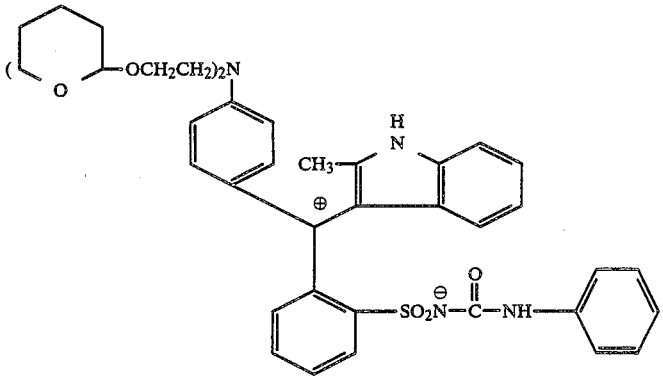
which upon heating above about 150° C. was rendered colorless.
Illustrative of other compounds of the present invention are those of the following formulae:
(a)
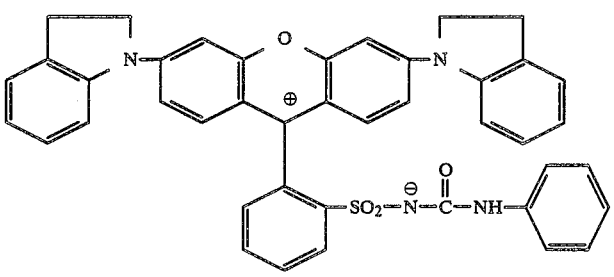
(b)
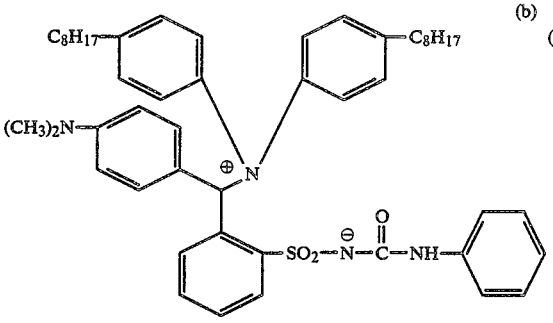
(c)
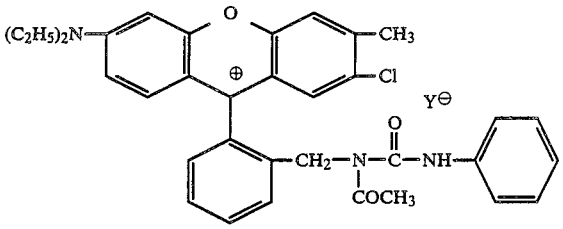
(d)
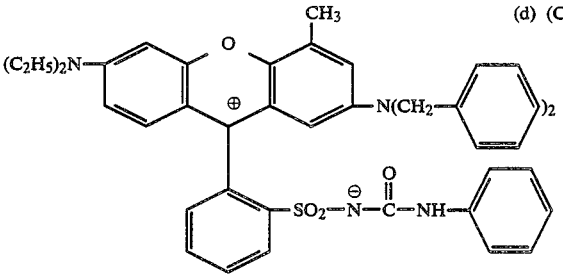
(e)
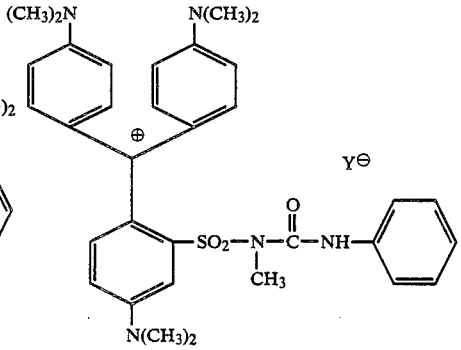

-continued (f)

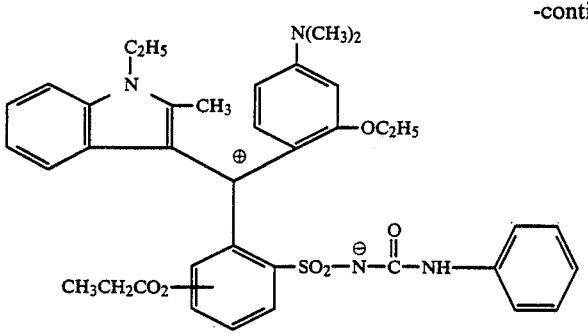

(g)

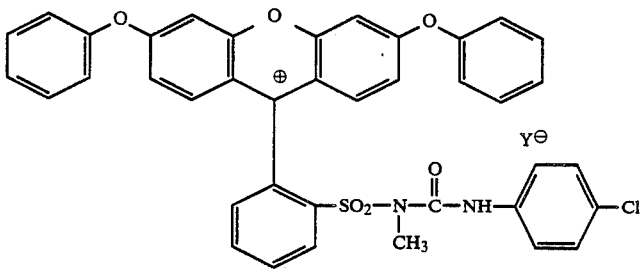

(h)

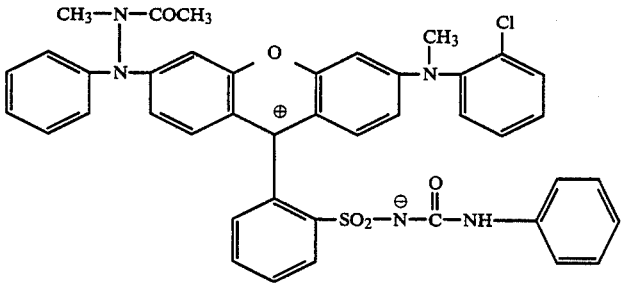

(i)

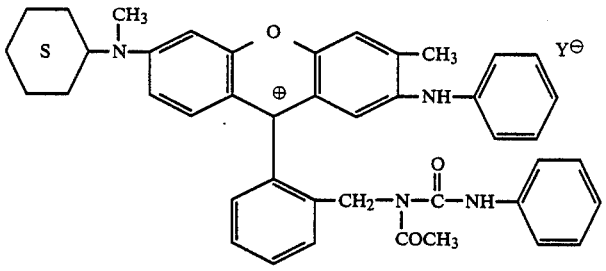

In producing images according to the present invention, the way in which the heat is applied or induced imagewise may be realized in a variety of ways, for example, by direct application of heat using a thermal printing head or thermal recording pen or by conduction from heated image-markings of an original using conventional thermographic copying techniques. Preferably, selective heating is produced in the heat-sensitive element itself by the conversion of electromagnetic radiation into heat and preferably, the light source is a laster beam emitting source such as a gas laser or semiconductor laser diode. The use of a laser beam is not only well suited for recording in a scanning mode but by utilizing a highly concentrated beam, photo-energy can be concentrated in a small area so that it is possible to record at high speed and high density. Also, it is a convenient way to record data as a heat pattern in response to transmitted signals such as digitized information and a convenient way of preparing multicolor images by employing a plurality of laser beam sources that emit laser beams of different wavelengths.

For example, using heat-sensitive compounds that absorb radiation at different predetermined wavelengths in the visible wavelength range, such as, yellow, magenta and cyan colored compounds, laser sources are selected that will emit at the wavelengths strongly absorbed by the respective compounds, and multicolor images can be prepared by addressing each color in a separate scan or preferably by addressing all of the colors in a single scan. Either way, the light absorbed by the respective heat-sensitive compounds is converted into heat and the heat brings about the unimolecular fragmentation of the thermally unstable urea moiety to effect bleaching of the compounds.

In a preferred embodiment, the heat-sensitive element contains an infra-red absorbing substance for converting infra-red radiation into heat which is transferred to the heat-sensitive compound to bring about said fragmentation reaction and effect the change in the absorption characteristics of the heat-sensitive compound. Obviously, the infra-red absorber should be in heat-conductive relationship with the heat-sensitive compound, for example, in the same layer as the heat-sensitive compound or in an adjacent layer. Preferably, the infra-red absorber is an organic compound, such as, a cyanine, merocyanine or thiopyrylium dye and preferably, is substantially non-absorbing in the visible region of the electromagnetic spectrum so that it will not add any substantial amount of color to the $D_{min}$ areas, i.e., the highlight areas of the image.

In the production of multicolor images, infra-red absorbers may be selected that absorb radiation at different predetermined wavelengths above 700 nm, which wavelengths are usually at least about 60 nm apart, so that each imaging layer may be exposed separately and independently of the others by using infra-red radiation at the particular wavelengths selectively absorbed by the respective infra-red absorbers. As an illustration, the layers of heat-sensitive compound for bleaching yellow, magenta and cyan may have infra-red absorbers associated therewith that absorb radiation at 760 nm, 820 nm and 1100 nm, respectively, and may be addressed by laser beam sources, for example, infra-red laser diodes emitting laser beams at these respective wavelengths so that the yellow imaging layer can be exposed independently of the magenta and cyan imaging layers, the magenta imaging layer can be exposed independently of the yellow and cyan imaging layers, and the cyan imaging layer can be exposed independently of the yellow and magenta imaging layers. While each layer may be exposed in a separate scan, it is usually preferred to expose all of the imaging layers simultaneously in a single scan using multiple laser beam sources of the appropriate wavelengths. Rather than using superimposed imaging layers, the heat-sensitive compounds and associated infra-red absorbers may be arranged in an array of side-by-side dots or stripes in a single recording layer.

In a further embodiment, multicolor images may be produced using the same infra-red absorbing compound in association with each of two or more superposed imaging layers and exposing each imaging layer by controlling the depth of focussing of the laser beam. In this embodiment, the concentration of infra-red absorber is adjusted so that each of the infra-red absorbing layers absorb approximately the same amount of laser beam energy. For example, where there are three infrered absorbing layers, each layer would absorb about one-third of the laser beam energy. It will be appreciated that controlling the focussing depth to address each layer separately may be carried out in combination with the previous embodiment of using infra-red absorbers that selectively absorb at different wavelengths in which instance the concentration of infra-red absorber would not have to be adjusted for the laser beam energy since the first infra-red dye would not absorb any substantial amount of radiation at the absorption peaks of the second and third dyes and so forth.

Where imagewise heating is induced by converting light to heat as in the embodiments described above, the heat-sensitive element may be heated prior to or during imagewise heating. This may be achieved using a heating platen or heated drum or by employing an additional laser beam source for heating the element while it is being exposed imagewise.

The heat-sensitive elements of the present invention comprise a support carrying at least one imaging layer of the above-denoted heat-sensitive compounds and may contain additional layers, for example, a subbing layer to improve adhesion to the support, interlayers for thermally isolating the imaging layers from each other, infra-red absorbing layers as discussed above, anti-static layers, an anti-abrasive topcoat layer which also may function as a UV protecting layer by including an ultraviolet absorber therein or other auxiliary layers. For example, an electroconductive layer may be included and imagewise color formation effected by heat energy in response to an electrical signal.

The heat-sensitive compounds are selected to give the desired color or combination of colors, and for multicolor images, the compounds selected may comprise the additive primary colors red, green and blue, the subtractive primaries yellow, magenta and cyan or other combinations of colors, which combinations may additionally include black. As noted previously, the compounds generally are selected to give the subtractive colors cyan, magenta and yellow as commonly employed in photographic processes to provide full natural color. Also, a black image may be formed by selecting a heat-sensitive compound which is a black dye.

The support employed may be transparent or opaque and may be any material that retains its dimensional stability at the temperature used for image formation. Suitable supports include paper, paper coated with a resin or pigment, such as, calcium carbonate or calcined clay, synthetic papers or plastic films, such as polyethylene, polypropylene, polycarbonate, cellulose acetate, polyethylene terephthalate and polystyrene.

Usually the layer of heat-sensitive compound contains a binder and is formed by combining the heat-sensitive compound and a binder in a common solvent, applying a layer of the coating composition to the support and then drying. Rather than a solution coating, the layer may be applied as a dispersion or an emulsion. The coating composition also may contain dispersing agents, plasticizers, defoaming agents, coating aids and materials such as waxes to prevent sticking where thermal recording heads or thermal pens are used to apply the imagewise pattern of heat. In forming the layer(s) containing the heat-sensitive compounds and the interlayers or other layers, temperatures should be maintained below levels that will initiate the fragmentation reaction so that the heat-sensitive compounds will not be prematurely bleached.

Any of the binders commonly employed in heat-sensitive recording elements may be employed provided that the binder selected is inert, i.e., does not have any adverse effect on the heat-sensitive compound incorporated therein. Also, the binder should be heat-stable at the temperatures encountered during image formation and it should be transparent so that it does not interfere with viewing of the color image. Where electromagnetic radiation is employed to induce imagewise heating, the binder also should transmit the light intended to initiate image formation. Examples of binders that may be used include polyvinyl alcohol, polyvinyl pyrrolidone, methyl cellulose, cellulose acetate butyrate, copolymers of styrene and butadiene, polymethyl methacrylate, copolymers of methyl and ethyl acrylate, polyvinyl acetate, polyvinyl chloride and polyvinyl butyral.

As discussed above, a visible change in spectral absorption characteristics is achieved according to the present invention by a unimolecular fragmentation of a thermally unstable urea moiety, and as can be seen from the results presented above, the initially colored ring-opened di- or triarylmethane compounds possessing an ortho-sulfonylurea phenyl group are decolorized upon heating to give a new, ring-closed di- or triarylmethane compound which is colorless.

Since certain changes may be made in the herein described subject matter without departing from the scope of the invention herein involved, it is intended that all matter contained in the above description and examples be interpreted as illustative and not in a limiting sense.

What is claimed is:

1. A heat-sensitive element comprising a support carrying at least one imaging layer of a colored di- or triarylmethane imaging compound possessing in its di- or triarylmethane structure an aryl group substituted in the ortho-position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members whereby said di- or triarylmethane compound becomes ring-closed and rendered colorless.

2. A heat-sensitive element as defined in claim 1 wherein said colored imaging compound is black.

3. A heat-sensitive element as defined in claim 1 which comprises at least two said imaging layers and said colored imaging compounds contained in said layers absorb radiation at different predetermined wavelengths in the visible region of the electromagnetic spectrum.

4. A heat-sensitive element as defined in claim 1 wherein an infra-red absorber is associated with said imaging layer of colored imaging compound for absorbing radiation at wavelengths about 700 nm and transferring said absorbed radiation as heat to said compound.

5. A heat-sensitive element as defined in claim 4 which comprises at least two said imaging layers, each said imaging layer of colored imaging compound having an infra-red absorber associated therewith.

6. A heat-sensitive element as defined in claim 5 wherein said infra-red absorbers associated with said imaging layers of imaging compound selectively absorb radiation at different predetermined wavelengths above 700 nm.

7. A heat-sensitive element as defined in claim 5 wherein said infra-red absorbers associated with said imaging layers of imaging compound absorb radiation at the same wavelength above 700 nm.

8. A heat-sensitive element as defined in claim 5 which additionally includes a thermal isolation layer between adjacent imaging layers.

9. A heat-sensitive element as defined in claim 8 wherein said support carries an imaging layer of said imaging compound for forming a cyan image, an imaging layer of said imaging compound for forming a magenta image and an imaging layer of said imaging compound for forming a yellow image.

10. A method of thermal imaging which comprises heating imagewise a heat-sensitive element comprising a support carrying at least one imaging layer of a colored di- or triarylmethane compound possessing in its di- or triarylmethane structure an aryl group substituted in the ortho-position to the meso carbon atom with a thermally unstable urea moiety, said urea moiety being capable of undergoing a unimolecular fragmentation reaction upon heating to provide a new group in said ortho position that bonds to said meso carbon atom to form a ring having 5 or 6 members whereby said di- or triarylmethane compound becomes ring-closed and rendered colorless in an imagewise pattern corresponding to said imagewise heating.

11. A method of thermal imaging as defined in claim 10 wherein said imaging layer of said colored imaging compound is heated imagewise by imagewise exposure to a laser beam source emitting radiation at a wavelength strongly absorbed by said compound.

12. A method of thermal imaging as defined in claim 11 wherein said element comprises at least two said imaging layers and said colored imaging compounds contained in said layers absorb radiation at different predetermined wavelengths in the visible region of the electromagnetic spectrum, said layers being heated imagewise by imagewise exposure to a plurality of laser beam sources emitting radiation at the respective wavelengths strongly absorbed by said compounds.

13. A method of thermal imaging as defined in claim 10 wherein an infra-red absorber is associated with said imaging layer of imaging compound for absorbing radiation at wavelengths above 700 nm and transferring said absorbed radiation as heat to said imaging compound, said layer being heated imagewise by imagewise exposure to infra-red radiation at a wavelength strongly absorbed by said infra-red absorber.

14. A method of thermal imaging as defined in claim 13 wherein said imaging layer is heated imagewise by imagewise exposure to a laser beam source emitting infra-red radiation at a wavelength strongly absorbed by said infra-red absorber.

15. A method of thermal imaging as defined in claim 14 wherein said element comprises at least two said imaging layers and said infra-red absorbers associated with each said imaging layer selectively absorb infra-red radiation at different predetermined wavelengths above 700 nm, said layers being heated by imagewise exposure to a plurality of laser beam sources emitting infra-red radiation at the respective wavelengths selectively absorbed by said infra-red absorbers.

16. A method of thermal imaging as defined in claim 14 wherein said element comprises at least two said imaging layers and said infra-red absorbers associated with said layers absorb infra-red radiation at the same wavelength or at different predetermined wavelengths above 700 nm, said imaging layers being heated imagewise by adjusting the depth of focus of a laser beam source emitting radiation at the wavelength absorbed by said infra-red absorber.

* * * * *